US005968269A

United States Patent [19]

Richter

[11] Patent Number: 5,968,269

[45] Date of Patent: Oct. 19, 1999

[54] COATER WITH MULTI-PART AND MULTI-USE PROFILE BAR ASSEMBLY

[75] Inventor: Daniel W. Richter, Appleton, Wis.

[73] Assignee: Voith Sulzer Paper Technology Noth America, Inc., Appleton, Wis.

[21] Appl. No.: 09/176,688

[22] Filed: Oct. 21, 1998

[51] Int. Cl.[6] ..... B05C 1/00

[52] U.S. Cl. ..... 118/118; 118/119; 118/123; 118/126; 118/261; 118/413

[58] Field of Search ..... 118/118, 119, 118/123, 126, 261, 413; 427/356

[56] References Cited

U.S. PATENT DOCUMENTS

| | | | |
|---|---|---|---|
| 2,695,004 | 11/1954 | Montgomery et al. | 118/109 |
| 5,286,526 | 2/1994 | Rantanen et al. | 427/356 |
| 5,433,781 | 7/1995 | Bernert | 118/118 |
| 5,599,392 | 2/1997 | Liang et al. | 118/110 |
| 5,749,972 | 5/1998 | Bernert et al. | 118/414 |

*Primary Examiner*—Laura Edwards
*Attorney, Agent, or Firm*—Taylor & Associates, P.C.

[57] ABSTRACT

A coater applies a coating medium onto a moving surface such as a fiber web. A coating element, such as a coater rod or coater blade, is configured for metering the coating medium to the moving surface. A profile bar assembly is connected to the mounting and movable toward and away from the coating element. The profile bar assembly includes a first profile bar attached to the mounting and a second profile bar removably attached to the first profile bar. Each of the first profile bar and the second profile bar carry a respective air load tube, with only one of the air load tubes engaging the coating element.

18 Claims, 2 Drawing Sheets

COATER WITH MULTI-PART AND MULTI-USE PROFILE BAR ASSEMBLY

BACKGROUND OF THE INVENTION

1. Field of the Invention

The present invention relates to a coater for applying a liquid or viscid medium to a moving surface (e.g., a fiber material web, applicator roll or backing roll), and, more particularly, to a coater for metering a coating mixture to a moving surface using a coater rod or coater blade.

2. Description of the Related Art

A coater for applying a liquid or viscid medium (such as coating color) to a moving surface may include a coating metering element in the form of a coater rod or coater blade which is positioned closely adjacent to the moving surface. The distance between the coater rod or coater blade and the moving surface during operation determines the thickness of the coating which is applied to the moving surface.

A coater rod is connected to a beam or mounting via a coater rod bed and a flexible support blade. The coater rod is rotatably carried by the coater rod bed and is driven in a rotational manner using an appropriate drive coupled with one or both ends of the rod. An air load tube positioned against the coater rod bed on a side generally opposite the coater rod biases the coater rod bed and coater rod toward the moving surface. The flexible support blade interconnects the coater rod bed with the mounting and is flexible to allow the coater rod to be moved toward and away from the moving surface using a solid profile bar and known adjustment devices, such as profile adjusting screws.

A coater blade is typically mounted directly to the mounting and is deflectable toward and away from the moving surface. An air load tube directly contacts the coater blade to bias the blade toward the moving surface. An eventually segmented profile bar bears on the air load tube. Each discrete segment is locally adjustable across the width of the coating blade in directions toward and away from the moving surface using known adjustment devices, such as profile adjusting screws.

With a metering element either in the form of a coater rod or a coater blade as described above, a profile bar dedicated exclusively for use with the corresponding type of metering element must be used. Thus, when it is desirable to switch from a coater blade to a coater rod, or vise versa, the profile bar which is designed for use with that particular type of metering element must be removed and replaced with a different type of profile bar. The process of removing one type of profile bar, installing another type of profile bar and adjusting the installed profile bar to within prescribed tolerances normally takes between 8 to 10 hours. This is obviously not desirable from an efficiency standpoint.

What is needed in the art is a coater having a profile bar assembly which is more readily adaptable for use with a metering element either in the form of a coater rod or a coater blade, and does not require extended change out times.

SUMMARY OF THE INVENTION

The present invention provides a coater having a profile bar assembly with a first profile bar attached to the mounting and configured to deflect a coater blade through an associated air tube, and a second profile bar removably attached to the first profile bar and configured to deflect a coater rod through an associated air tube.

The invention comprises, in one form thereof, a coater for applying a coating medium onto a moving surface such as a fiber web. A coating element, such as a coater rod or coater blade, is configured for applying the coating medium to the moving surface. A profile bar assembly is connected to the mounting and movable toward and away from the coating element. The profile bar assembly includes a first profile bar attached to the mounting and a second profile bar removably attached to the first profile bar. Each of the first profile bar and the second profile bar carry a respective air load tube, with only one of the air load tubes engaging the coating element.

An advantage of the present invention is that the second profile bar can be detached from the first profile bar if the metering element is in the form of a coater blade.

Another advantage is that when a coater blade is used and the second profile bar is removed, foreign particles are less likely to accumulate on top of the first profile bar.

Yet another advantage is that removal of the second profile bar allows easy access to the coater blade for cleaning of the coater blade.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplification is not to be construed as limiting the scope of the invention in any manner.

DETAILED DESCRIPTION OF THE INVENTION

Figure 1:
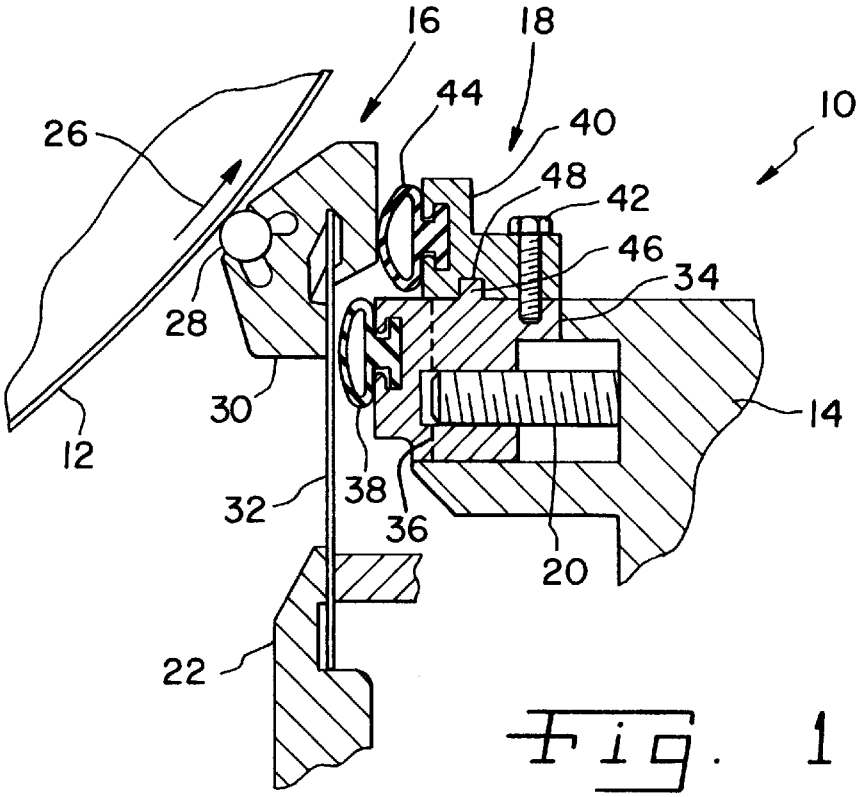
FIG. 1 is a side view of a coater including an embodiment of a profile bar assembly of the present invention used with a coater rod.

Referring now to the drawings, and more particularly to FIG. 1, there is shown an embodiment of a coater 10 which is used for applying a liquid or viscous coating medium onto a moving surface 12. Coater 10 generally includes a beam or mounting 14, a coating element assembly in the form of a coater rod assembly 16, a profile bar assembly 18, a plurality of profile adjustment spindles (one of which is shown and referenced as 20), and a blade support bar 22.

Moving surface 12, in the embodiment shown, is in the form of a fiber web which moves in the direction indicated by arrow 26. It is thus appreciated by those skilled in the art that coater 10 carries out a direct application of the liquid or viscous medium on moving surface 12. Moving surface 12 may also be in the form of an applicator roll or a backing roll which moves in a particular rotational direction, dependent upon the specific application. When configured as an applicator roll, it is apparent to those skilled in the art that coater 10 would apply the liquid or viscous medium to the fiber web in an indirect manner via an intermediate application of the medium on the applicator roll.

Coater rod assembly 16 includes a coating element in the form of a coater rod 28 which is rotatably carried by a coater rod bed 30, which in turn is connected to mounting 14 via a flexible support element in the form of a flexible support blade 32. More particularly, flexible support blade 32 is clamped near one end thereof against blade support bar 22. An opposing end of flexible support blade 32 is received within coater rod bed 30.

Profile bar assembly 18 is connected with mounting 14 and is movable generally toward and away from coater rod 28. More particularly, profile bar assembly 18 includes a first profile bar 34 which is slidably coupled with mounting 14 through the use of a plurality of adjustment spindles 20. The plurality of adjustment spindles 20 are preferably equidistantly spaced across the width of profile bar assembly 18 (i.e., in a direction transverse to the drawing plane of FIG. 1), and threadingly engage first profile bar 34 at the respective spaced apart contact points. Simultaneous rotation of all adjustment spindles in a given direction causes sliding movement of first profile bar 34 toward or away from coater rod 28 of coater rod assembly 16. First profile bar 34 includes a plurality of vertical cuts (one of which is represented by phantom line 36) which open on the side opposite flexible support blade 32. Each pair of adjacent cuts 36 defines a segment of profile bar 34 therebetween. Each adjustment spindle 20 engages a corresponding segment approximately midway between the adjacent pair of cuts 36.

First profile bar 34 also includes an air load tube 38 which is carried thereby on a side facing toward flexible support blade 32. When profile bar assembly 18 is used in conjunction with a coater rod assembly 16 as shown in FIG. 1, air load tube 38 is not used and does not contact flexible support blade 32.

Profile bar assembly 18 also includes a second profile bar 40 which is removably attached to the top of first profile bar 34. In the embodiment shown, second profile bar 40 is removably attached to first profile bar 34 using a plurality of fasteners such as bolts 42 which are spaced apart across the width of profile bar assembly 18. In the embodiment shown, second profile bar 40 is in the form of a solid, non-segmented profile bar which carries an air load tube 44 which directly engages coater rod bed 30 of coater rod assembly 16. With second profile bar 40 constructed in a non-segmented manner as shown, profile bar assembly 18 is not intended to provide for local adjustment of coater rod 28 across the width thereof. The solid and non-segmented second profile bar 40 substantially inhibits local deformation of profile bar assembly 18. However, it is also possible to form second profile bar 40 as a segmented profile bar with segments which substantially align with the segments of first profile bar 34, thereby allowing local adjustment of profile bar assembly 18.

First profile bar 34 and second profile bar 40 preferably each include mating keying arrangements. In the embodiment shown, first profile bar 34 includes aligned projections 46 which extend upwardly from each segment across the width of first profile bar 34. Second profile bar 40 includes a mating recess 48 which extends across the width of the bottom surface thereof. Mating projections 46 and recess 48 allow second profile bar 40 to be relatively quickly attached to first profile bar 34 at the desired location and within predetermined tolerances. Moreover, projections 46 and recess 48 allow the solid, non-segmented construction of second profile bar 40 to substantially inhibit the local adjustment of first profile bar 34 which otherwise would be possible through the use of the vertical cuts 36 formed in first profile bar 34. Additionally, by forming projections 46 on first profile bar 34, dirt is prevented from accumulating on first profile bar 34 when second profile bar 40 is not attached therewith. That is, if first profile bar 34 were formed with a recess 48 rather than a projection 46, dirt would be allowed to accumulate within the recess when second profile bar 40 is not attached with first profile bar 34.

During use, adjustment spindles 20 are substantially simultaneously rotated in a particular direction to cause movement of first profile bar 34 toward or away from coater rod 28. Alternatively, adjustment spindles 20 can be independently rotated to provide a slight profiling effect on coater rod 28. Air load tube 44, being connected with first profile bar 34 through the use of non-segmented second profile bar 40, directly engages coater rod bed 30. Movement of coater rod bed 30 toward moving surface 12 in turn causes movement of coater rod 28 toward moving surface 12, thereby defining the thickness of the coating medium which is applied to moving surface 12.

Figure 2:
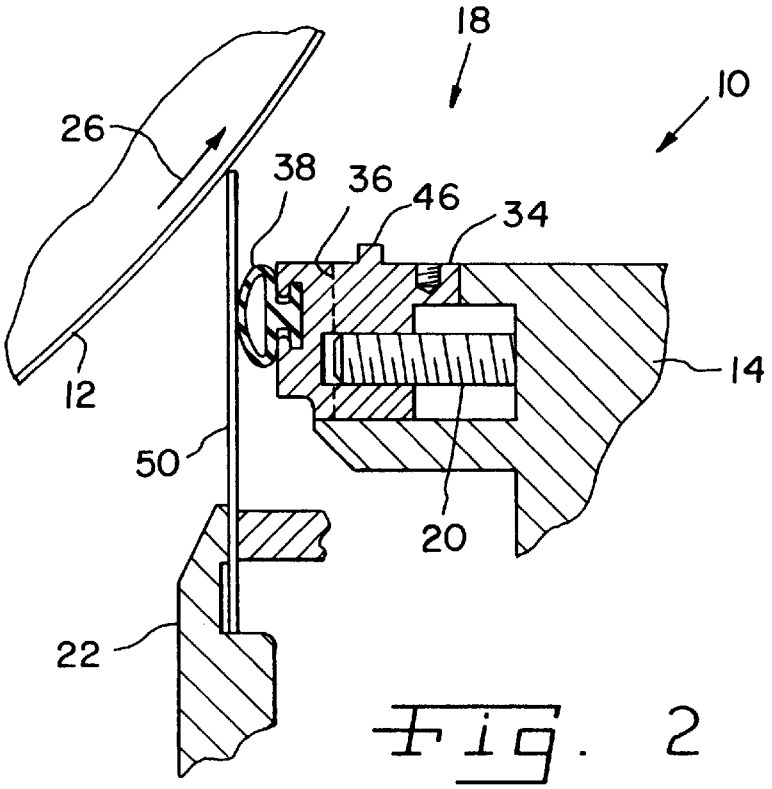
FIG. 2 is a side view of a coater including the profile bar assembly of FIG. 1 used with a coater blade and having the top profile bar removed.

Referring now to FIG. 2, coater 10 is shown with a coating element in the form of a coater blade 50 which applies the coating medium to moving surface 12. Profile bar assembly 18 again moves toward and away from coater blade 50 to adjust the coating thickness on moving surface 12. However, second profile bar 40 is detached from first profile bar 34. Thus, air load tube 38 carried by first profile bar 34 bears directly against coater blade 50. Since the solid, non-segmented second profile bar 40 is not attached to first profile bar 34, the vertical cuts 34 may be effectively utilized to allow local adjustment or profiling of coater blade 50 across the width thereof. That is, each separate adjustment spindle 20 may be independently controlled to provide for local profiling of coater blade 50.

In addition to providing the local profiling of coater blade 50 as described above, the removal of second profile bar 40 from first profile bar 34 also allows easier access to and maintenance of coater blade 50. If a foreign particle is trapped at the working edge of coater blade 50 which causes streaks in the coating applied to moving surface 12, a user may easily access the working edge of coater blade 50 to dislodge the foreign particle. Additionally, if second profile bar 40 was positioned on top of first profile bar 34 when profile bar assembly 18 is used with a coater blade, a pocket of unused space would be created between the air load tube carried by the second profile bar 40 and coater blade 50. Dirt could accumulate in the pocket, and in turn contaminate the coating applied to moving surface 12. Removal of the otherwise unused second profile bar 40 when profile bar assembly 18 is used in conjunction with coater blade 50 thus eliminates the possibility of dirt and other foreign matter accumulating in the pocket which would otherwise be formed adjacent the working edge of coater blade 50.

During use, adjustment spindles 20 may be independently controlled to provide for local deformation of first profile bar 34, and thus provide for local profiling of the coating which is applied to moving surface 12. If it is desirable to replace coater blade 50 with coater rod assembly 16, coater blade 50 is removed and replaced with coater rod assembly 16. Second profile bar 40 is then placed on top of first profile bar 34 such that the mating keying arrangements in the form of projections 46 and recess 48 mate with each other. The tolerances between projections 46 and recess 48 are designed such that second profile bar 40 does not need to be re-zeroed for use with coater rod assembly 16. This saves a substantial amount of labor and also substantially reduces down time of coater 10. Since first profile bar 34 need not be removed from mounting 14 regardless of which type of metering element is utilized during the coating process, profile bar assembly 18 would only be re-zeroed when tolerance specifications are exceeded, and not simply because a different type of metering element is used.

Figure 3:
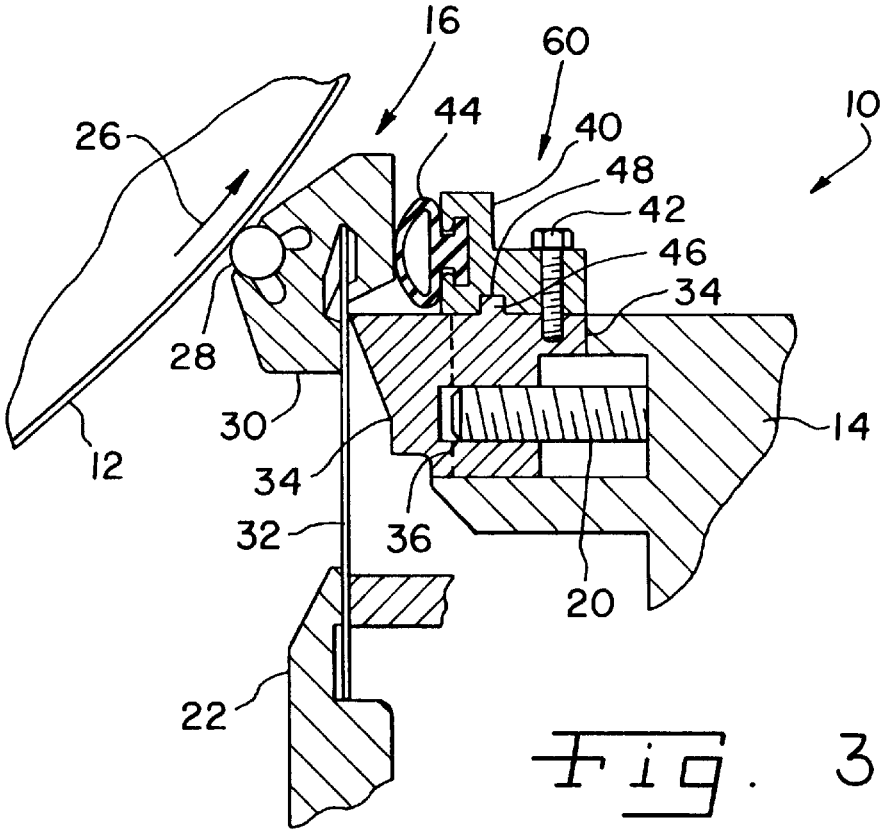
FIG. 3 is a side view of a coater including another embodiment of a profile bar assembly of the present invention used with a coater rod.
Figure 4:
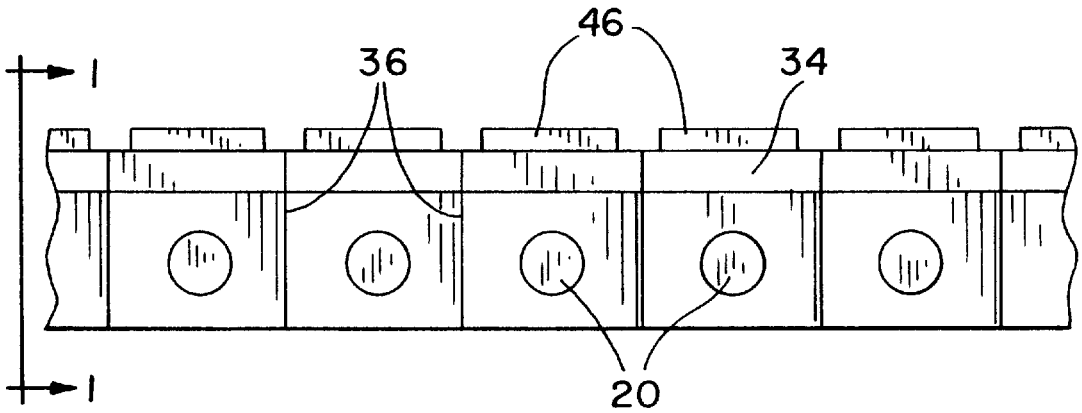
FIG. 4 is a front view of the first profile bar and profile adjustment spindles of FIG. 1.

FIG. 3 illustrates another embodiment of a profile bar assembly 60 used in a coater 10. Profile bar assembly 60 includes a first profile bar 34 and a second profile bar 40, similar to the embodiment of profile bar assembly 18 shown in FIGS. 1 and 2. However, first profile bar 34 does not include and carry an air load tube 38. Rather, first profile bar 34 defines a line contact for engaging flexible support blade 32. In the embodiment shown in FIG. 3, first profile bar 34 and second profile bar 40 each engage coater rod assembly 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A coater for applying a coating medium onto a moving surface, said coater comprising:

a mounting;

a coating element configured for applying the coating medium to the moving surface; and a profile bar assembly connected to said mounting and movable toward and away from said coating element, said profile bar assembly including a first profile bar slidably coupled with said mounting and a second profile bar removably and fixedly attached to said first profile bar, each of said first profile bar and said second profile bar carrying a respective air load tube, one of said air load tubes engaging said coating element.

2. The coater of claim 1, wherein said first profile bar includes a keying arrangement and said second profile bar includes a mating keying arrangement.

3. The coater of claim 2, wherein said keying arrangement of said first profile bar includes one of a projection and a recess, and said keying arrangement of said second profile bar includes an other of a mating projection and a recess.

4. The coater of claim 1, wherein said coating element comprises a coater blade and said air load tube carried by said first profile bar engages said coater blade.

5. The coater of claim 1, wherein said coating element comprises a coater rod assembly with a coater rod and said air load tube carried by said second profile bar engages said coater rod assembly.

6. The coater of claim 5, further comprising a flexible support element interconnecting said mounting with said coater rod bed.

7. The coater of claim 6, wherein said flexible support element comprises a flexible support blade.

8. The coater of claim 1, wherein said coating element is directly attached to said mounting.

9. The coater of claim 1, wherein said first profile bar and said second profile bar directly contact each other, and one of said air tubes directly contacts said coating element.

10. A coater for applying a coating medium onto a moving surface, said coater comprising:

a mounting;

a coating element configured for applying the coating medium to the moving surface;

a profile bar assembly connected to said mounting and movable toward and away from said coating element, said profile bar assembly including a first profile bar slidably coupled with said mounting and a second profile bar removably attached to said first profile bar, each of said first profile bar and said second profile bar carrying a respective air load tube, one of said air load tubes engaging said coating element, said first profile bar including a plurality of abutted segments extending across a width of said coating element; and a plurality of adjustment devices for locally deflecting said coating element toward the moving surface, each said adjustment device engaging a respective one of said segments.

11. The coater of claim 10, wherein said first profile bar includes a plurality of cuts therein which define said abutted segments therebetween.

12. The coater of claim 10, wherein said second profile bar comprises a solid, non-segmented profile bar.

13. The coater of claim 12, wherein said second profile bar is disposed on top of said first profile bar.

14. The coater of claim 10, wherein each said adjustment device comprises an adjustment spindle.

15. A coater for applying a coating medium onto a moving surface, said coater comprising:

a mounting;

a coating element configured for applying the coating medium to the moving surface; and a profile bar assembly connected to said mounting and movable toward and away from said coating element, said profile bar assembly including a first profile bar slidably coupled with said mounting and a second profile bar removably and fixedly attached to said first profile bar, said second profile bar including an air load tube, at least one of said first profile bar and said second profile bar engaging said coating element.

16. The coater of claim 15, wherein said first profile bar engages said coating element.

17. The coater of claim 15, wherein said second profile bar engages said coating element.

18. The coater of claim 15, wherein each of said first profile bar and said second profile bar is configured for pushing said coating element in a same direction.

* * * * *